United States Patent [19]

Pollastrini et al.

[11] Patent Number: 4,929,340

[45] Date of Patent: May 29, 1990

[54] CATALYST AND PROCESS FOR SWEETENING A SOUR HYDROCARBON FRACTION USING DIPOLAR COMPOUNDS

[75] Inventors: Sheila Pollastrini, Bloomingdale; Jeffery C. Bricker, Buffalo Grove; Robert R. Frame, Glenview, all of Ill.

[73] Assignee: UOP, Des Plaines, Ill.

[21] Appl. No.: 386,923

[22] Filed: Jul. 31, 1989

[51] Int. Cl.[5] ..... C10G 19/00; C10G 27/00; C10G 29/00

[52] U.S. Cl. ..... 208/189; 208/202; 208/203; 208/204; 208/206; 208/207

[58] Field of Search ..... 208/189, 203, 207

[56] References Cited

U.S. PATENT DOCUMENTS

| | | | |
|---|---|---|---|
| 2,918,426 | 12/1959 | Quiquerez et al. | 208/206 |
| 2,966,453 | 12/1960 | Gleim et al. | 208/206 |
| 2,988,500 | 6/1961 | Gleim et al. | 208/206 |
| 3,108,081 | 10/1963 | Gleim et al. | 252/428 |
| 3,108,948 | 10/1963 | Ring | 208/189 |
| 3,252,892 | 5/1966 | Gleim et al. | 208/206 |
| 3,980,582 | 9/1976 | Anderson et al. | 252/428 |
| 4,019,869 | 4/1977 | Morris | 23/288 R |
| 4,033,860 | 7/1977 | Carlson | 208/206 |
| 4,156,641 | 5/1979 | Frame | 208/207 |
| 4,201,626 | 5/1980 | Asdigian | 196/14.52 |
| 4,207,173 | 6/1980 | Stansky, Jr. | 208/207 |
| 4,234,544 | 11/1980 | Christman | 422/256 |
| 4,290,913 | 9/1981 | Frame | 252/428 |
| 4,298,463 | 11/1981 | Frame | 208/189 |
| 4,337,147 | 6/1982 | Frame | 208/206 |
| 4,490,246 | 12/1984 | Verachtert | 208/206 |
| 4,498,977 | 2/1985 | Frame | 208/189 |
| 4,498,978 | 2/1985 | Frame | 208/189 |
| 4,502,949 | 3/1985 | Fram et al. | 208/189 |
| 4,672,047 | 6/1987 | Chandler | 208/189 |
| 4,753,722 | 6/1988 | Le et al. | 208/207 |
| 4,824,818 | 4/1989 | Bricku et al. | 208/189 |

*Primary Examiner*—Helane Myers

*Attorney, Agent, or Firm*—Thomas K. McBride; Eugene I. Snyder; Frank S. Molinaro

[57] ABSTRACT

This invention relates to an improved process and catalyst for treating a sour hydrocarbon stream. The improvement comprises the use of a dipolar compound which has a positively charged atom and an electronegative group in the same structure. A particularly preferred dipolar compound is ephedrine. The dipolar compounds may be used in conjunction with a metal chelate and a basic solution either in a liquid-liquid process or a fixed bed process with substantially increased performance for oxidizing mercaptans which are found in the sour hydrocarbon stream.

22 Claims, No Drawings

CATALYST AND PROCESS FOR SWEETENING A SOUR HYDROCARBON FRACTION USING DIPOLAR COMPOUNDS

BACKGROUND OF THE INVENTION

Processes for the treatment of a sour hydrocarbon fraction where the fraction is treated by contacting it with an oxidation catalyst and an alkaline agent in the presence of an oxidizing agent at reaction conditions have become well known and widely practiced in the petroleum refining industry. These processes are typically designed to effect the oxidation of offensive mercaptans contained in a sour hydrocarbon fraction to innocuous disulfides—a process commonly referred to as sweetening. The oxidizing agent is most often air. Gasoline, including natural, straight run and cracked gasolines, is the most frequently treated sour hydrocarbon fraction. Other sour hydrocarbon fractions which can be treated include the normally gaseous petroleum fraction as well as naphtha, kerosene, jet fuel, fuel oil, and the like.

A commonly used continuous process for treating sour hydrocarbon fractions entails contacting the fraction with a metal phthalocyanine catalyst dispersed in an aqueous caustic solution to yield a doctor sweet product. The sour fraction and the catalyst containing aqueous caustic solution provide a liquid-liquid system wherein mercaptans are converted to disulfides at the interface of the immiscible solutions in the presence of an oxidizing agent—usually air. Sour hydrocarbon fractions containing more difficult to oxidize mercaptans are more effectively treated in contact with a metal chelate catalyst dispersed on a high surface area adsorptive suport—usually a metal phthalocyanine on an activated charcoal. The fraction is treated by contacting it with the supported metal chelate catalyst at oxidation conditions in the presence of an alkaline agent. One such process is described in U.S. Pat. No. 2,988,500. The oxidizing agent is most often air admixed with the fraction to be treated, and the alkaline agent is most often an aqueous caustic solution charged continuously to the process or intermittently as required to maintain the catalyst in the causticwetted state.

The prior art shows that the usual practice of catalytically treating a sour hydrocarbon fraction containing mercaptans involves the introduction of alkaline agents, usually sodium hydroxide, into the sour hydrocarbon fraction prior to or during the treating operation. See U.S. Pat. Nos. 3,108,081 and 4,156,641. The prior art also discloses that quaternary ammonium compounds can improve the activity of these catalytic systems. For example, see U.S. Pat. Nos. 4,290,913 and 4,337,147. In these patents the catalytic composite comprises a metal chelate, an alkali metal hydroxide and a quaternary ammonium hydroxide dispersed on an adsorptive support.

The prior art also discloses the use of other nitrogen-containing compounds as promoters for mercaptan sweetening. For example, U.S. Pat. No. 4,207,173 discloses the use of guanidine as a promoter for mercaptan oxidation. Further, U.S. Pat. No. 4,753,722 discloses a large number of nitrogen-containing compounds as promoters. These compounds are classified as heterocyclic compounds, substituted homocyclic compounds and aliphatic compounds.

In contrast to this prior art, applicants have found that a dipolar compound can greatly promote the oxidation of mercaptans in both liquid-liquid and fixed bed processes. A dipolar compound is an organic compound which has a positively charged atom and an electronegative group in the same structure. A preferred class of dipolar compounds are betaines which have the general formula $$(R')_3N^+CH_2COO^-$$

where R′ is an alkyl, alkaryl and cycloalkyl group. An especially preferred dipolar compound is ephedrine which has the formula

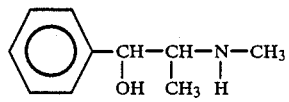

and in which the hydroxyl group is capable of being deprotonated. There is no mention in the prior art that such dipolar compounds would be effective promoters for the oxidation of mercaptans. Further, applicants have found that the dipolar compounds are much more active promoters than quaternary ammonium compounds.

The dipolar compounds of this invention can have the structural formula

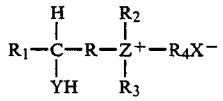

(A)

or

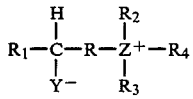

(B)

where Z is nitrogen or phosphorus, $R, R_1, R_2, R_3$ and $R_4$ are groups as defined herein and X is halogen or hydroxide. It is noted that these compounds can be considered quaternary ammonium compounds (when Z is nitrogen), especially formula (A). However, there is no mention in the prior art that quaternary ammonium compounds can have an electronegative group as a moiety in the structure. Further, there is no indication in the prior art that a quaternary ammonium compound containing an electronegative group would be a better promoter than a quaternary ammonium compound without an electronegative group. Applicants are the first to have discovered this unexpected result.

SUMMARY OF THE INVENTION

It is a broad objective of this invention to present improved processes and catalysts for treating a sour hydrocarbon fraction containing mercaptans. Thus, one broad embodiment of the invention is a process for treating a sour hydrocarbon fraction containing mercaptans comprising contacting the hydrocarbon fraction in the presence of an oxidizing agent with a basic solution containing a metal chelate effective in oxidizing said mercaptans to disulfides, wherein the improvement comprises a dipolar compound present in the basic solution, the dipolar compound having the structural formula

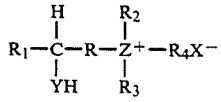

(A)

where Z is nitrogen or phosphorus, R is a linear alkyl group having from one to about 18 carbon atoms, $R_1$ and $R_2$ are each individually hydrogen or a hydrocarbon group selected from the group consisting of alkyl, aryl, alkaryl, aralkyl and cycloalkyl, $R_3$ and $R_4$ are each individually a hydrocarbon group selected from the group consisting of alkyl, aryl, alkaryl, aralkyl and cycloalkyl, YH is an electronegative group selected from the group consisting of OH, SH, COOH, $SO_3H$ and $NH_2$, the electronegative group characterized in that it is capable of being deprotonated in a basic solution, and X is an anion selected from the group consisting of the halogens and hydroxide; or the structural formula

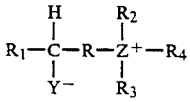

(B)

where $Y^-$ is the deprotonated form of YH.

Another embodiment of the invention is a process for treating a sour hydrocarbon fraction containing mercaptans comprising contacting the hydrocarbon fraction in the presence of an oxidizing agent with a basic solution containing a metal chelate effective in oxidizing said mercaptans to disulfides, wherein the improvement comprises a dipolar compound present in the basic solution, the dipolar compound selected from the group consisting of an ephedrine compound, an ephedrine salt and mixtures thereof, where the ephedrine compound has the structural formula

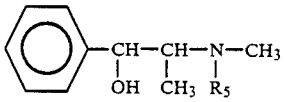

where $R_5$ is hydrogen or an alkyl group having from 1 to about 25 carbon atoms and the ephedrine salt has the structural formula

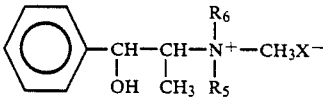

where $R_5$ is as defined above, $R_6$ is an alkyl or cycloalkyl group having from 1 to about 25 carbon atoms and X is an anion selected from the group consisting of hydroxide, chloride and bromide.

Yet another embodiment of the invention is a process for treating a sour hydrocarbon fraction containing mercaptans comprising contacting the hydrocarbon fraction in the presence of an oxidizing agent and a basic agent with a catalyst effective in oxidizing the mercaptans to disulfides, wherein the improvement comprises a catalyst comprising an adsorbent support having dispersed thereon a metal chelate and a dipolar compound having the structural formula

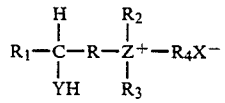

(A)

where Z is nitrogen or phosphorus, R is a linear alkyl group having from one to about 18 carbon atoms, $R_1$ and $R_2$ are each individually hydrogen or a hydrocarbon group selected from the group consisting of alkyl, aryl, alkaryl, aralkyl and cycloalkyl, $R_3$ and $R_4$ are each individually a hydrocarbon group selected from the group consisting of alkyl, aryl, alkaryl, aralkyl and cycloalkyl, YH is an electronegative group selected from the group consisting of OH, SH, COOH, $SO_3H$ and $NH_2$, the electronegative group characterized in that it is capable of being deprotonated in a basic solution, and X is an anion selected from the group consisting of the halogens and hydroxide; or the structural formula

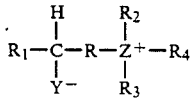

(B)

where $Y^-$ is the deprotonated form of YH.

Still another embodiment of the invention is a process for treating a sour hydrocarbon fraction containing mercaptans comprising contacting the hydrocarbon fraction in the presence of an oxidizing agent and a basic agent with a catalyst effective in oxidizing the mercaptans to disulfides, wherein the improvement comprises a catalyst comprising an adsorbent support having dispersed thereon a metal chelate and a dipolar compound selected from the group consisting of an ephedrine compound, an ephedrine salt or a mixture thereof as described above.

A further broad embodiment of the invention is a catalyst effective for oxidizing mercaptans present in a sour hydrocarbon fraction comprising a basic solution containing a metal chelate and a promoter which is a dipolar compound having the structural formula

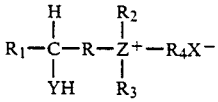

(A)

where Z is nitrogen or phosphorus, R is a linear alkyl group having from one to about 18 carbon atoms, $R_1$ and $R_2$ are each individually hydrogen or a hydrocarbon group selected from the group consisting of alkyl, aryl, alkaryl, aralkyl and cycloalkyl, $R_3$ and $R_4$ are each individually a hydrocarbon group selected from the group consisting of alkyl, aryl, alkaryl, aralkyl and cycloalkyl, YH is an electronegative group selected from the group consisting of OH, SH, COOH, $SO_3H$ and $NH_2$, the electronegative group characterized in that it is capable of being deprotonated in a basic solution, and X is an anion selected from the group consisting of the halogens and hydroxide; or the structural formula

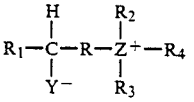

(B)

where $Y^-$ is the deprotonated form of YH.

Still another embodiment of the invention is a catalyst effective for oxidizing mercaptans present in a sour hydrocarbon fraction comprising an adsorbent support having dispersed thereon a metal chelate and a dipolar compound having the structural formula

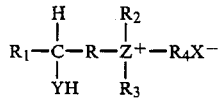

(A)

where Z is nitrogen or phosphorus, R is a linear alkyl group having from one to about 18 carbon atoms, $R_1$ and $R_2$ are each individually hydrogen or a hydrocarbon group selected from the group consisting of alkyl, aryl, alkaryl, aralkyl and cycloalkyl, $R_3$ and $R_4$ are each individually a hydrocarbon group selected from the group consisting of alkyl, aryl, alkaryl, aralkyl and cycloalkyl, YH is an electronegative group selected from the group consisting of OH, SH, COOH, $SO_3H$ and $NH_2$, the electronegative group characterized in that it is capable of being deprotonated in a basic solution, and X is an anion selected from the group consisting of the halogens and hydroxide; or the structural formula

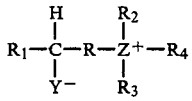

(B)

where $Y^-$ is the deprotonated form of YH.

A further embodiment of the invention is a catalyst effective for oxidizing mercaptans present in a sour hydrocarbon fraction comprising an adsorbent support having dispersed thereon a metal chelate and a dipolar compound selected from the group consisting of an ephedrine compound, an ephedrine salt and mixtures thereof as described above.

Yet another embodiment of the invention is a catalyst effective for oxidizing mercaptans in a sour hydrocarbon fraction comprising a basic solution containing a metal chelate and a dipolar compound selected from the group consisting of an ephedrine compound, an ephedrine salt and mixtures thereof as described above.

Other objects and embodiments of this invention will become apparent in the following detailed description of the invention.

DETAILED DESCRIPTION OF THE INVENTION

As stated, this invention relates to improved processes and catalysts for treating a sour hydrocarbon fraction. The process comprises contacting a sour hydrocarbon fraction in the presence of an oxidizing agent with a catalyst. The catalyst can be present either in a liquid phase (liquid-liquid sweetening) or as a solid phase (fixed bed sweetening).

The liquid-liquid process comprises contacting the sour hydrocarbon fraction with a basic solution containing a metal chelate and a dipolar compound. The basic solution is an aqueous solution containing from about 0.1 to about 25 weight percent, preferably from about 0.1 to about 10 weight percent, and most preferably from about 0.5 to about 7 weight percent of an alkali metal hydroxide or ammonium hydroxide. Of the alkali metal hydroxides, sodium and potassium hydroxides are preferred, although lithium hydroxide, rubidium hydroxide and cesium hydroxide may also be used. The metal chelate employed in the practice of this invention can be any of the various metal chelates known to the art as effective in catalyzing the oxidation of mercaptans contained in a sour petroleum distillate, to disulfides or polysulfides. The metal chelates include the metal compounds of tetrapyridinoporphyrazine described in U.S. Pat. No. 3,980,582, e.g., cobalt tetrapyridinoporphyrazine; porphyrin and metaloporphyrin catalysts as described in U.S. Pat. No. 2,966,453, e.g., cobalt tetraphenylporphyrin sulfonate; corrinoid catalysts as described in U.S. Pat. No. 3,252,892, e.g., cobalt corrin sulfonate; chelate organometallic catalysts such as described in U.S. Pat. No. 2,918,426, e.g., the condensation product of an aminophenol and a metal of Group VIII; the metal phthalocyanines as described in U.S. Pat. No. 4,290,913, etc. As stated in U.S. Pat. No. 4,290,913, metal phthalocyanines are a preferred class of metal chelates. All the above-named patents are incorporated herein by reference.

The metal phthalocyanines which can be employed in the basic solution to catalyze the oxidation of mercaptans generally include magnesium phthalocyanine, titanium phthalocyanine, hafnium phthalocyanine, vanadium phthalocyanine, tantalum phthalocyanine, molybdenum phthalocyanine, manganese phthalocyanine, iron phthalocyanine, cobalt phthalocyanine, platinum phthalocyanine, palladium phthalocyanine, copper phthalocyanine, silver phthalocyanine, zinc phthalocyanine, tin phthalocyanine, and the like. Cobalt phthalocyanine and vanadium phthalocyanine are particularly preferred. The ring substituted metal phthalocyanines are generally employed in preference to the unsubstituted metal phthalocyanine (see U.S. Pat. No. 4,290,913), with the sulfonated metal phthalocyanine being especially preferred, e.g., cobalt phthalocyanine monosulfate, cobalt phthalocyanine disulfonate, etc. The sulfonated derivatives may be prepared, for example, by reacting cobalt, vanadium or other metal phthalocyanine with fuming sulfuric acid. While the sulfonated derivatives are preferred, it is understood that other derivatives, particularly the carboxylated derivatives, may be employed. The carboxylated derivatives are readily prepared by the action of trichloroacetic acid on the metal phthalocyanine. The concentration of metal chelate in general and metal phthalocyanine in specific in the basic solution can vary from about 0.1 to about 2000 ppm and preferably from about 50 to about 800 ppm.

The dipolar compound which may be used as a promoter along with the metal chelate in the basic solution has the formula

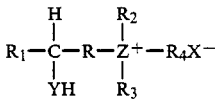

(A)

where Z is nitrogen or phosphorus, R is a linear alkyl group having from one to about 18 carbon atoms, $R_1$ and $R_2$ are each individually hydrogen or a hydrocarbon group selected from the group consisting of alkyl, aryl, alkaryl, aralkyl and cycloalkyl, $R_3$ and $R_4$ are each individually a hydrocarbon group selected from the group consisting of alkyl, aryl, alkaryl, aralkyl and cycloalkyl, YH is an electronegative group selected from the group consisting of OH, SH, COOH, $SO_3H$ and $NH_2$, the electronegative group characterized in that it is capable of being deprotonated in a basic solution, and X is an anion selected from the group consisting of the halogens and hydroxides; or the structural formula

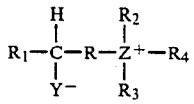

(B)

where $Y^-$ is the deprotonated form of YH. Specifically, the deprotonated forms of the YH groups enumerated above are $O^-$, $S^-$, $COO^-$, $SO_3^-$, and $NH^-$. A preferred counter ion, X, is chloride. It should be pointed out that regardless of which structure the dipolar compound has, when it is dissolved in a basic solution the dipolar compound exists to at least some measurable extent as structure (B) or what is usually referred to as an inner salt or a zwitter ion. The choice of using the dipolar compound in form A or B is merely a choice of convenience and availability and does not affect the activity of the dipolar compound. Illustrative examples of the dipolar compounds which can be used to practice this invention, but which are not intended to limit the scope of this invention are Z=nitrogen, $Y^-=COO^-$, $R_1=H$, $R=CH_2$, $R_2=R_3=R_4=$ethyl; Z=nitrogen, $Y^-=COO^-$, $R_1=H$, $R=CH_2$, $R_2=R_3=R_4=$methyl; Z=nitrogen, $Y^-=COO^-$, $R_1=H$, $R=CH_2$, $R_2=$hexadecyl, $R_3=R_4=$methyl; Z=nitrogen, $Y^-=COO^-$, $R_1=H$, $R=(CH_2)_3$, $R_2=R_3=R_4=$methyl; Z=nitrogen, $Y^-=COO^-$, $R_1=H$, $R=(CH_2)_3$, $R_2=$decyl, $R_3=R_4=$methyl; Z=nitrogen, $Y^-=COO^-$, $R_1=H$, $R=(CH_2)_6$, $R_2=R_3=R_4=$methyl; Z=nitrogen, $Y^-=COO^-$, $R_1=H$, $R=CH_2$, $R_2=$coco, $R_3=R_4=$methyl; Z=nitrogen, $Y^-=COO^-$, $R_1=H$, $R=CH_2$, $R_2=$tallow, $R_3=R_4=$methyl; Z=nitrogen, $YH=SO_3H$, $R_1=H$, $R=(CH_2)_2$, $R_2=$tallow, $R_3=R_4=$methyl, X=Cl; Z=nitrogen, $YH=SO_3H$, $R_1=H$, R=tallow, $R_2=R_3=R_4=$methyl, X=Cl; Z=nitrogen, YH=COOH, $R_1=H$, $R=CH_2$, $R_2=$tallow, $R_3=R_4=$methyl, X=Cl; Z=nitrogen, YH=OH, $R_1=H$, $R=(CH_2)_4$, $R_2=$decyl, $R_3=R_4=$methyl, X=Cl; Z=phosphorus, $Y^-=COO^-$, $R_1=H$, $R=CH_2$, $R_2=R_3=R_4=$methyl; Z=phosphorus, $Y^-=COO^-$, $R_1=H$, $R=CH_2$, $R_2=$decyl, $R_3=R_4=$methyl; Z=phosphorus, $Y^-=COO^-$, $R_1=H$, R=decyl, $R_2=R_3=R_4=$methyl; Z=phosphorus, YH=COOH, $R_1=H$, $R=(CH_2)_3$, $R_2=R_3=R_4=$methyl, X=Cl; Z=phosphorus, YH=COOH, $R_1=H$, $R=CH_2$, $R_2=$coco, $R_3=R_4=$methyl, X=Cl.

The term coco and tallow refer to a mixture of linear alkyl groups as shown in Table A. The exact composition of coco and tallow groups may vary slightly from those shown in Table A depending on the source and purity of the material.

TABLE A

| Component | Coco (%) | Tallow (%) |
|---|---|---|
| $C_8$ | 7.0 | — |
| $C_{10}$ | 6.0 | — |
| $C_{12}$ | 48.0 | — |
| $C_{14}$ | 19.0 | 3.5 |
| $C_{16}$ | 9.0 | 29.5 |
| $C_{18}$ | 11.0 | 67.0 |
| Total | 100.0 | 100.0 |

Preferred dipolar compounds are ones in which $R_3$ and $R_4$ are both a linear alkyl group containing from about 5 to about 20 carbon atoms. Specific preferred dipolar compounds are Z=nitrogen, $Y^-=COO^-$, $R_1=H$, $R=CH_2$, $R_2=R_3=R_4=$methyl; and Z=nitrogen, $Y=COO^-$, $R_1=H$, $R=CH_2$, $R_2=R_3=$methyl, $R_4=$tallow.

Another preferred series of dipolar compounds are ephedrine compounds and ephedrine salts. The ephedrine compounds have the structural formula

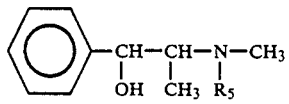

When $R_5$ is hydrogen, the compound is ephedrine. In addition to $R_5$ being hydrogen, $R_5$ may also be an alkyl group having from 1 to about 25 carbon atoms. Examples of the alkyl group are methyl, ethyl, propyl, decyl, dodecyl, etc. The ephedrine salts have the structural formula

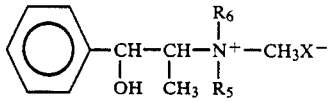

where $R_5$ is hydrogen or an alkyl group having from 1 to about 25 carbon atoms, $R_6$ is an alkyl, alkaryl or cycloalkyl group having from 1 to about 25 carbon atoms and X is an anion selected from the group consisting of hydroxide, chloride, bromide, iodide and fluoride. Ephedrine is an especially preferred dipolar compound. Mixtures of the ephedrine compounds and ephedrine salts may be used in the practice of the invention.

Regardless of the dipolar compound actually used, it is desirable that the dipolar compound be present in the basic solution in a concentration from about 0.1 to about 400 ppm, preferably from about 1 to about 100 ppm and most preferably from about 3 to about 20 ppm.

Sweetening of the sour hydrocarbon fraction is effected by oxidation of mercaptans. Accordingly, an oxidizing agent is necessary for the reaction to proceed. Air is a preferred oxidizing agent, although oxygen or other oxygen-containing gases may be used. At least a stoichiometric amount of oxygen (relative to the concentration of mercaptans) is required to oxidize the mercaptans to disulfides, although an excess amount of oxygen is usually employed. In some cases the sour hydrocarbon fraction may contain entrained air or oxygen in sufficient concentration to accomplish the desired sweetening, but generally it is preferred to introduce air into the reaction zone.

Sweetening of the sour hydrocarbon fraction may be effected in any suitable manner well known in the art and may be in a batch or continuous process. In a batch process the sour hydrocarbon fraction is introduced into a reaction zone containing the basic solution which contains the metal chelate and the dipolar compound. Air is introduced therein or passed therethrough. Preferably the reaction zone is equipped with suitable stirrers or other mixing devices to obtain intimate mixing. In a continuous process the basic solution containing the metal chelate catalyst and the dipolar compounds is passed countercurrently or concurrently with the sour hydrocarbon fraction in the presence of a continuous stream of air. In a mixed type process, the reaction zone contains the basic solution, metal chelate and dipolar compound, and gasoline and air are continuously passed therethrough and removed generally from the upper portion of the reaction zone. For specific examples of apparatus used to carry out a liquid/liquid process, see U.S. Pat. Nos. 4,019,869, 4,201,626 and 4,234,544 which are incorporated by reference.

In general the process is usually effected at ambient temperatures, although elevated temperatures may be employed and generally will be in the range of from about 100° to about 400° F., depending upon the pressure utilized therein, but usually below that at which substantial vaporization occurs. Pressures of up to about 1,000 psi or more are operable although atmospheric or substantially atmospheric pressures are suitable.

The process may also be carried out by contacting the sour hydrocarbon fraction with a catalyst comprising a metal chelate and a dipolar compound dispersed on an adsorbent support. This is referred to as fixed bed sweetening. The adsorbent support which may be used in the practice of this invention can be any of the well known adsorbent materials generally utilized as a catalyst support or carrier material. Preferred adsorbent materials include the various charcoals produced by the destructive distillation of wood, peat, lignite, nutshells, bones, and other carbonaceous matter, and preferably such charcoals as have been heat-treated or chemically treated or both, to form a highly porous particle structure of increased adsorbent capacity, and generally defined as activated carbon or charcoal. Said adsorbent materials also include the naturally occurring clays and silicates, e.g., diatomaceous earth, fuller's earth, kieselguhr, attapulgus clay, feldspar, montorillonite, halloysite, kaolin, and the like, and also the naturally occurring or synthetically prepared refractory inorganic oxides such as alumina, silica, zirconia, thoria, boria, etc., or combinations thereof like silica-alumina, silica-zirconia, alumina-zirconia, etc. The absorbent support should be insoluble in, and otherwise inert to, the petroleum distillate at the alkaline reaction conditions existing in the treating zone. Charcoal, and particularly activated charcoal, is preferred because of its capacity for metal chelates, and because of its stability under treating conditions.

The metal chelates which can be deposited on the support are the ones that have been described above for the liquid-liquid process. Likewise, the dipolar compounds are the same as described above including ephedrine compounds and ephedrine salts.

The metal chelate component and dipolar compound can be dispersed on the adsorbent support in any conventional or otherwise convenient manner. The components can be dispersed on the support simultaneously from a common aqueous or alcoholic solution and/or dispersion thereof or separately and in any desired sequence. The dispersion process can be effected utilizing conventional techniques whereby the support in the form of spheres, pills, pellets, granules or other particles of uniform or irregular size or shape, is soaked, suspended, dipped one or more times, or otherwise immersed in an aqueous or alcoholic solution and/or dispersion to disperse a given quantity of the dipolar compound and metal chelate components. Typically, the dipolar compound will be present in a concentration of about 0.01 to about 5 weight percent of the catalyst and preferably from about 0.1 to about 3 weight percent. In general, the amount of metal chelate and metal phthalocyanine in particular which can be adsorbed on the solid adsorbent support and still form a stable catalyst is up to about 25 weight percent of the catalyst. A lesser amount in the range of from about 0.1 to about 10 weight percent of the catalyst generally forms a suitably active catalyst.

One preferred method of preparation involves the use of a steam-jacketed rotary dryer. The adsorbent support is immersed in the impregnating solution and/or dispersion containing the desired components contained in the dryer and the support is tumbled therein by the rotating motion of the dryer. Evaporation of the solution in contact with the tumbling support is expedited by applying steam to the dryer jacket. In any case, the resulting composite is allowed to dry under ambient temperature conditions, or dried at an elevated temperature in an oven, or in a flow of hot gases, or in any other suitable manner to yield a suitable catalyst.

An alternative and convenient method for dispersing the dipolar compound and metal chelate components on the solid adsorbent support comprises predisposing the support in a sour hydrocarbon fraction treating zone or chamber as a fixed bed and passing a metal chelate and dipolar compound solution and/or dispersion through the bed in order to form the catalytic composite in situ. This method allows the solution and/or dispersion to be recycled one or more times to achieve a desired concentration of the dipolar compound and metal chelate components on the adsorbent support. In still another alternative method, the adsorbent support may be predisposed in said treating zone or chamber, and the zone or chamber thereafter filled with the solution and/or dispersion to soak the support for a predetermined period.

Processes for sweetening a sour hydrocarbon fraction using a fixed bed catalyst are described in the prior art. Specifically, temperature and pressure conditions are the same as stated for the liquid-liquid process described above. The prior art also discloses (see U.S. Pat. Nos. 4,033,860 and 4,337,147) that the hydrocarbon fraction can be treated in the presence of a basic agent, usually an alkaline agent. Thus, a supported catalyst is typically initially saturated with an aqueous solution of an alkaline agent (as described above) and the alkaline agent thereafter passed in contact with the catalyst bed continuously or intermittently as required, admixed with the sour hydrocarbon fraction. An aqueous ammonium hydroxide solution (as described above) may be used in place of the alkaline solution. The aqueous solution may further contain a solubilizer to promote mercaptan solubility, e.g., alcohol, and especially methanol, ethanol, n-propanol, isopropanol, etc., and also phenols, cresols, and the like. The solublizer, when employed, is preferably methanol, and the alkaline solution may suitably contain from about 2 to about 10 volume percent thereof. Examples of specific arrangements to carry out the treating process may be found in U.S. Pat. Nos. 4,490,246 and 4,753,722 which are incorporated by reference.

The following examples are presented in illustration of this invention and are not intended as undue limitations on the generally broad scope of the invention as set out in the appended claims.

EXAMPLE 1

A stirred contactor which consisted of a cylindrical glass container measuring 3.5 inches in diameter by 6 inches high and which contained 4 baffles that are at 90° angles to the side walls was used. An air driven motor was used to power a paddle stirrer positioned in the center of the apparatus. When turning, the stirrer paddles passed within ½" of the baffles. This resulted in a very efficient, pure type of mixing.

To the above apparatus there were added 50 milliliters of an 8% aqueous sodium hydroxide solution which contained 30 weight ppm of a caustic soluble tetrasulfonated cobalt phthalocyanine and 200 milliliters of isooctane which contained 1,300 weight ppm of mercaptan sulfur as n-octylmercaptan. To this mixture 20 ppm of a mixture of quaternary ammonium compounds composed of alkyldimethylbenzyl ammonium chloride and dialkymethylbenzyl ammonium chloride obtained from the Mason Chemical Co. as Maquat FL-76, was added and the mixture was stirred. Periodically stirring was stopped and a sample was withdrawn from the isooctane layer with a pipette. These samples were analyzed for mercaptan by titration and are presented in Table 1.

EXAMPLE 2

The test described in Example 1 was carried out with a fresh sample of isooctane, cobalt phthalocyanine and alkaline solution, but instead of the quaternary ammonium compound, 20 ppm of ephedrine was added. These results are also presented in Table 1.

EXAMPLE 3

The test described in Example 1 was carried out with a fresh sample of isooctane, cobalt phthalocyanine and alkaline solution, but instead of the quaternary ammonium compound, 20 ppm of a betaine having the structural formula

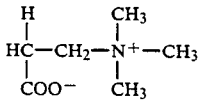

obtained from Aldrich Chemical Co. was added. These results are also presented in Table 1.

TABLE 1

Effect of Dipolar Compounds on Mercaptan Oxidation

| Contact Time (Minutes) | Mercaptan Conversion, % | | |
|---|---|---|---|
| | Quat OH | Ephedrine | Betaine |
| 10 | 14 | 37 | 67 |
| 20 | 25 | 95 | 100 |
| 30 | 31 | 100 | 100 |
| 50 | 40 | 100 | 100 |
| 70 | 48 | 100 | 100 |
| 90 | 56 | 100 | 100 |

The data clearly show the superior promotion effect of dipolar compounds such as ephedrine and betaine.

We claim as our invention:

1. In a process for treating a sour hydrocarbon fraction containing mercaptans comprising contacting the hydrocarbon fraction in the presence of an oxidizing agent with a basic solution containing a metal chelate effective in oxidizing said mercaptans to disulfides, the improvement comprising a dipolar compound present in the basic solution, the dipolar compound having the structural formula

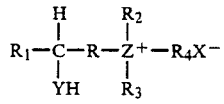

(A)

where Z is nitrogen or phosphorus, R is a linear alkyl group having from one to about 18 carbon atoms, $R_1$ and $R_2$ are each individually hydrogen or a hydrocarbon group selected from the group consisting of alkyl, aryl, alkaryl, aralkyl and cycloalkyl, $R_3$ and $R_4$ are each individually a hydrocarbon group selected from the group consisting of alkyl, aryl, alkaryl, aralkyl and cycloalkyl, YH is an electronegative group selected from the group consisting of OH, SH, COOH, $SO_3H$ and $NH_2$, the electronegative group characterized in that it is capable of being deprotonated in a basic solution, and X is an anion selected from the group consisting of the halogens, and hydroxide; or the structural formula

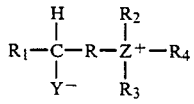

(B)

where $Y^-$ is the deprotonated form of YH.

2. The process of claim 1 where $R_3$ and $R_4$ are both a linear alkyl group containing from about 5 to about 20 carbon atoms.

3. The process of claim 1 where the basic solution is a sodium hydroxide solution containing from about 0.1 to about 25 weight percent sodium hydroxide.

4. The process of claim 1 where the basic solution is an aqueous solution containing from about 0.1 to about 25 weight percent ammonium hydroxide.

5. The process of claim 1 where the oxidizing agent is oxygen or air.

6. The process of claim 1 where the metal chelate is a metal phthalocyanine.

7. The process of claim 6 where the metal phthalocyanine is a cobalt phthalocyanine and is present in a concentration from about 0.1 to about 2000 ppm.

8. The process of claim 1 where the dipolar compound is present in a concentration from about 0.1 to about 400 ppm.

9. In a process for treating a sour hydrocarbon fraction containing mercaptans comprising contacting the hydrocarbon fraction in the presence of an oxidizing agent with a basic solution containing a metal chelate effective in oxidizing said mercaptans to disulfides, the improvement comprising a dipolar compound present in the basic solution, the dipolar compound selected from the group consisting of an ephedrine compound, an ephedrine salt and mixtures thereof where the ephedrine compound has the structural formula

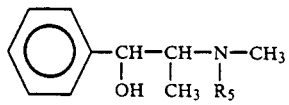

where $R_5$ is hydrogen or an alkyl group having from 1 to about 25 carbon atoms, and the ephedrine salt has the structural formula

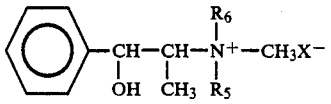

where $R_6$ is an alkyl, alkaryl, or cycloalkyl group having from 1 to about 25 carbon atoms and X is an anion selected from the group consisting of hydroxide, chloride, bromide, iodide and fluoride.

10. The process of claim 9 where the dipolar compound is present in a concentration from about 0.1 to about 400 ppm.

11. The process of claim 9 where the oxidizing agent is oxygen or air.

12. The process of claim 9 where the metal chelate is a metal phthalocyanine.

13. The process of claim 12 where the metal phthalocyanine is a cobalt phthalocyanine and is present in a concentration from about 0.1 to about 2000 ppm.

14. In a process for treating a sour hydrocarbon fraction containing mercaptans comprising contacting the hydrocarbon fraction in the presence of an oxidizing agent and a basic agent with a catalyst effective in oxidizing the mercaptans to disulfides, the improvement comprising a catalyst comprising an adsorbent support having dispersed thereon a metal chelate and a dipolar compound having the structural formula

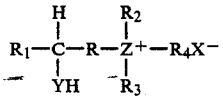

(A)

where Z is nitrogen or phosphorus, R is a linear alkyl group having from one to about 18 carbon atoms, $R_1$ and $R_2$ are each individually hydrogen or a hydrocarbon group selected from the group consisting of alkyl, aryl, alkaryl, aralkyl and cycloalkyl, $R_3$ and $R_4$ are each individually a hydrocarbon group selected from the group consisting of alkyl, aryl, alkaryl, aralkyl and cycloalkyl, YH is an electronegative group selected from the group consisting of OH, SH, COOH, $SO_3H$ and $NH_2$, the electronegative group characterized in that it is capable of being deprotonated in a basic solution, and X is an anion selected from the group consisting of the halogens and hydroxide; or the structural formula

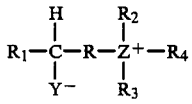

(B)

where $Y^-$ is the deprotonated form of YH.

15. The process of claim 14 where $R_3$ and $R_4$ are both a linear alkyl group containing from about 5 to about 20 carbon atoms.

16. The process of claim 14 where the metal chelate is a metal phthalocyanine.

17. The process of claim 16 where the metal phthalocyanine is a cobalt phthalocyanine and is present in a concentration from about 0.1 to about 10 weight percent of the catalyst.

18. The process of claim 14 where the dipolar compound is present in a concentration from about 0.01 to about 5 weight percent.

19. In a process for treating a sour hydrocarbon fraction containing mercaptans comprising contacting the hydrocarbon fraction in the presence of an oxidizing agent and a basic agent with a catalyst effective in oxidizing the mercaptans to disulfides, the improvement comprising a catalyst comprising an adsorbent support having dispersed thereon a metal chelate and a dipolar compound selected from the group consisting of an ephedrine compound, an ephedrine salt and mixtures thereof, the ephedrine compound having the structural formula

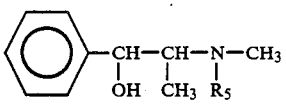

where $R_5$ is hydrogen or an alkyl group having from 1 to about 25 carbon atoms, and the ephedrine salt has the structural formula

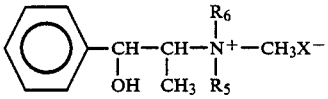

where $R_6$ is an alkyl, alkaryl or cycloalkyl group having from 1 to about 25 carbon atoms and X is an anion selected from the group consisting of hydroxide, chloride, bromide, iodide and fluoride.

20. The process of claim 19 where the dipolar compound is present in a concentration from about 0.1 to about 5 weight percent of the catalyst.

21. The process of claim 19 where the metal chelate is a metal phthalocyanine.

22. The process of claim 21 where the metal phthalocyanine is a cobalt phthalocyanine and is present in a concentration from about 0.1 to about 10 weight percent of the catalyst.

* * * * *